US011225074B2

(12) United States Patent
Cumbie et al.

(10) Patent No.: US 11,225,074 B2
(45) Date of Patent: Jan. 18, 2022

(54) FLUIDIC DIES WITH INLET AND OUTLET CHANNELS

(71) Applicant: HEWLETT-PACKARD DEVELOPMENT COMPANY, L.P., Spring, TX (US)

(72) Inventors: Michael W. Cumbie, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,431

(22) PCT Filed: Sep. 11, 2017

(86) PCT No.: PCT/US2017/050901

§ 371 (c)(1),
(2) Date: Oct. 3, 2019

(87) PCT Pub. No.: WO2019/050540

PCT Pub. Date: Mar. 14, 2019

(65) Prior Publication Data

US 2020/0198340 A1 Jun. 25, 2020

(51) Int. Cl.

| | |
|---|---|
| ***B41J 2/175*** | (2006.01) |
| ***B41J 2/14*** | (2006.01) |
| ***B41J 2/045*** | (2006.01) |

(52) U.S. Cl.

CPC ..... *B41J 2/1404* (2013.01); *B41J 2/0458* (2013.01); *B41J 2/14145* (2013.01); *B41J 2/04543* (2013.01); *B41J 2/175* (2013.01); *B41J 2002/14467* (2013.01); *B41J 2202/12* (2013.01)

(58) Field of Classification Search

CPC ..... B41J 2/14145; B41J 2/18; B41J 2002/14467; B41J 2202/12

See application file for complete search history.

(56) References Cited

U.S. PATENT DOCUMENTS

| | | | |
|---|---|---|---|
| 6,055,002 | A | 4/2000 | Wen |
| 6,231,174 | B1 | 5/2001 | Haigo |
| 8,820,895 | B2 | 9/2014 | Bibl et al. |
| 9,278,368 | B2 | 3/2016 | Bibl et al. |
| 9,381,739 | B2 | 7/2016 | Govyadinov et al. |

(Continued)

FOREIGN PATENT DOCUMENTS

| | | |
|---|---|---|
| EP | 3192657 | 7/2017 |
| JP | 2002192723 | 7/2002 |

(Continued)

*Primary Examiner* — Scott A Richmond
(74) *Attorney, Agent, or Firm* — Fabian VanCott

(57) ABSTRACT

In one example in accordance with the present disclosure, a fluidic ejection die is described. The die includes an array of nozzles. Each nozzle includes an ejection chamber, an opening, and a fluid actuator disposed within the ejection chamber. Each nozzle also includes an inlet passage to deliver fluid into the ejection chamber and an outlet passage to deliver fluid out of the ejection chamber. The fluidic ejection die also includes an array of channels divided into inlet channels and outlet channels. Each inlet channel is fluidly connected to a respective plurality of inlet passages and each outlet channel is fluidly connected to a respective plurality of outlet passages.

20 Claims, 8 Drawing Sheets

(56) References Cited

U.S. PATENT DOCUMENTS

| | | | | |
|---|---|---|---|---|
| 9,604,212 | B2 | 3/2017 | Govyadinov et al. | |
| 2011/0007117 | A1* | 1/2011 | Bibl | B41J 2/1433 347/70 |
| 2012/0160925 | A1 | 6/2012 | Hoisington et al. | |
| 2013/0027466 | A1 | 1/2013 | Petruchik et al. | |
| 2013/0292089 | A1 | 11/2013 | Norcross | |
| 2014/0063132 | A1 | 3/2014 | Scheffelin | |
| 2016/0052292 | A1 | 2/2016 | Wells et al. | |
| 2016/0059555 | A1 | 3/2016 | Tamura et al. | |
| 2016/0185124 | A1* | 6/2016 | Govyadinov | B41J 2/175 347/92 |

FOREIGN PATENT DOCUMENTS

| | | |
|---|---|---|
| JP | 2015150881 | 8/2015 |
| JP | 2015180551 | 10/2015 |
| JP | 2016159514 | 9/2016 |
| JP | 2017001247 | 1/2017 |
| JP | 2017124615 | 7/2017 |
| JP | 2017144634 | 8/2017 |

* cited by examiner

FLUIDIC DIES WITH INLET AND OUTLET CHANNELS

BACKGROUND

A fluidic die is a component of a fluid system that moves fluid. One example of a fluidic die is a fluidic ejection die that includes a number of fluid ejecting nozzles. The fluidic dies and fluidic ejection dies can also include other non-ejecting actuators such as micro-recirculation pumps. Through these nozzles and pumps, fluid, such as ink and fusing agent among others, is ejected or moved. For example, nozzles may include an ejection chamber that holds an amount of fluid and a fluid actuator within the ejection chamber operates to eject the fluid through an opening of the nozzle.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
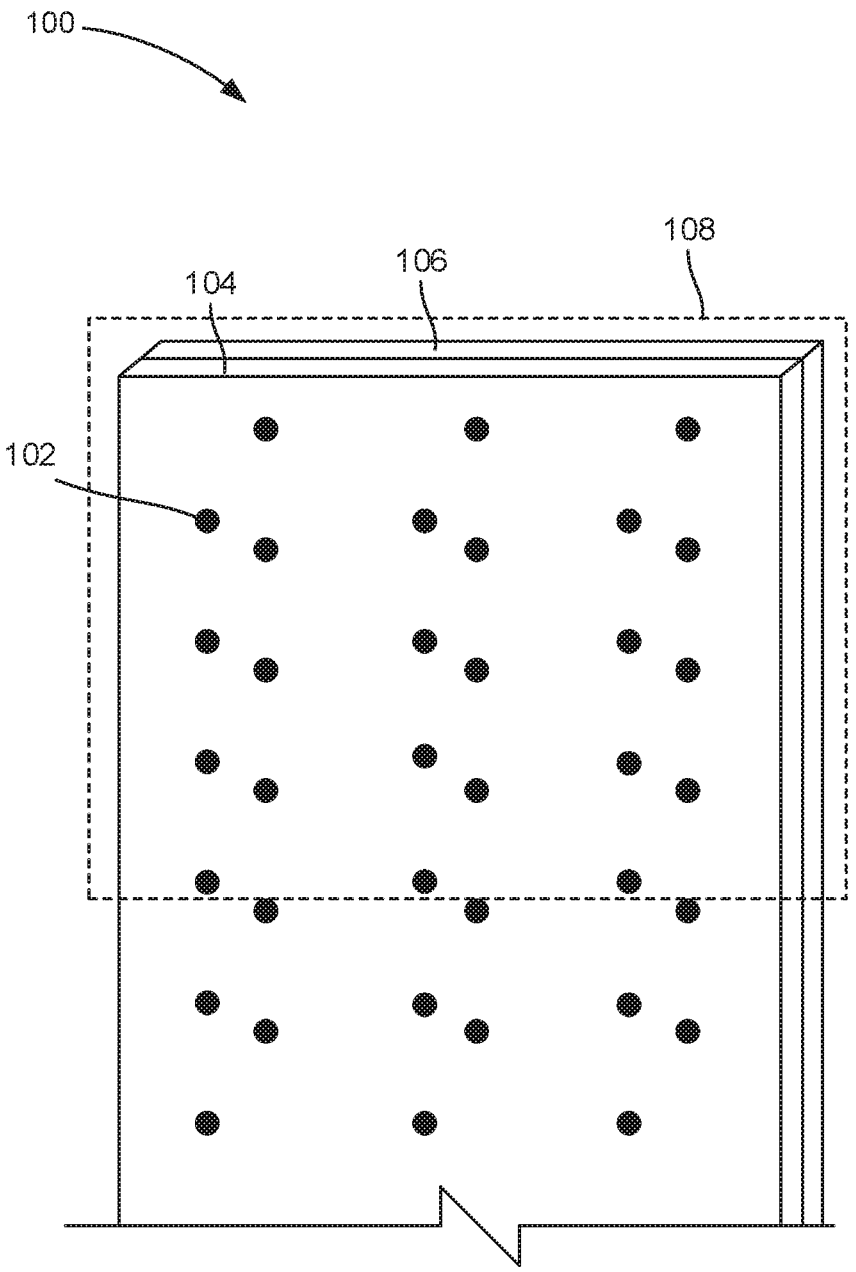
FIG. 1A is a view of a fluidic ejection die with inlet and outlet channels, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include fluidic ejection dies, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed. In fluidic dies that are not ejection dies, fluid is not ejected, but rather passed through a channel to be analyzed or otherwise processed, for example in life science applications.

In a specific example, these fluidic dies are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid ejection systems dispense ink on a two-dimensional print medium such as paper. For example, during inkjet printing, fluid is directed to a fluid ejection die. Depending on the content to be printed, the device in which the fluid ejection die is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used. Accordingly, as has been described, the systems and methods described herein may be implemented in two-dimensional printing, i.e., depositing fluid on a substrate, and in three-dimensional printing, i.e., depositing a fusing agent or other functional agent on a material base to form a three-dimensional printed product.

While such fluidic dies and fluidic ejection dies have increased in efficiency in moving and ejecting various types of fluid, enhancements to their operation can yield increased performance. As one example, the operation of some actuators may alter the composition of the fluid passing through the fluidic die. For example, a thermal ejector heats up in response to an applied voltage. As the thermal ejector heats up, a portion of the fluid in an ejection chamber vaporizes to form a bubble. This bubble pushes fluid out the opening and onto the print medium. Non-ejecting actuators found in non-ejecting, and ejecting dies operate similarly. After a number of actuations of the actuators, portions of the fluid evaporate such that the fluid becomes depleted of water. In other words, the fluid becomes more concentrated and more viscous. Fluid that is depleted of water can negatively impact the nozzles and can result in reduced fluid quality.

This is partly addressed by circulating the fluid passing to the nozzle and/or to the chamber. However, the desirable impact of recirculating mechanisms is reduced due to fluid mechanics. For example, fluid is supplied to the fluidic die via a fluid supply slot. A macro-recirculation system includes an external pump that drives fluid through these fluid supply slots. Due to the narrowness of the fluidic die, this macro-recirculation flow may not penetrate deep enough into the fluid supply slot to be drawn into the micro-recirculation loop. That is the fluid supply slot separates the macro-recirculation flow from the micro-recirculation flow. Accordingly, the fluid in the micro-recirculation loop is not replenished, but instead the same volume of fluid is recycled through the loop. As fluid that is recycled through the loop is exposed to various actuation cycles, it loses quality and may negatively impact printing and/or fluid properties.

Accordingly, the present specification describes a fluidic ejection die that solves these and other issues. That is, the present specification describes a system and method that force flow into the fluidic ejection die, in a transverse direction. In this example, a die slot is replaced with an inlet passage and an outlet passage that are linked to channels on the back of the fluidic ejection die. More specifically, nozzles through which fluid is ejected are disposed on a front surface of the fluidic ejection die. Fluid is supplied to these nozzles via the backside. The enclosed channels promote flow closer to the fluidic ejection die. That is, without the channels, fluid that is supplied to an inlet of the fluidic ejection die by the fluid supply slots has a low velocity, insufficient to come close to the micro-recirculation loops. In this example, fluid is circulating throughout the microfluidic loops, but the fluid is not replenished from the fluid supply.

The channels, via fluid dynamics, increase the flow close to the micro-recirculation loops such that they are replenished with new fluid. That is, the micro-recirculation flow draws fluid from, and ejects fluid into a macro-recirculation flow traveling through the channels. Accordingly, in this example, the micro-recirculation loop and nozzles are provided with new, fresh fluid.

That is, a micro-recirculation flow draws fluid into, and ejects fluid out of, passages in a pulsating manner that creates secondary flows and vortices. These vortices dissipate a certain distance from the passages. The channels draw the macro-recirculating flow directly to these vortices such that the macro-recirculating fluid interacts with these vortices at sufficient flow velocity so that mixing between the macro-recirculating fluid and the fluid in the micro-recirculation loop is accelerated. Without the channels to force the macro-recirculating fluid to close proximity of the micro-recirculation loops, the macro-recirculating fluid will not reach into a fluid supply slot with sufficient velocity to interact with the vortices around entrances/exits of the micro-recirculation loop. This increased flow also enhances cooling as fresh ink is more effective at drawing heat from the fluidic die than is depleted, or recycled, fluid.

Even when fluid is effectively replenished in the micro-recirculation loop, the waste fluid coming out of a micro-recirculation loop may be deposited into the same fluid channel from which fresh fluid is delivered. That is, the waste fluid mixes with the fresh fluid in the fluid supply slot. The mixing of the waste fluid with the fresh fluid can reduce the quality of the fresh fluid being delivered to the nozzles.

Accordingly, the present specification also describes dies and systems that address this issue. Specifically, according to the present specification, inlet passages to nozzles are aligned with inlet channels and waste fluid passes through outlet passages to outlet channels. That is, channels that deliver fluid to the nozzle are separated from channels that receive waste fluid from the nozzles. Separating fluid delivered to the nozzle from waste fluid exiting a nozzle ensures that higher quality fluid is made available to nozzles for deposition on a surface such as a print medium.

Specifically, the present specification describes a fluidic ejection die. The fluidic ejection die includes an array of nozzles to eject an amount of fluid. Each nozzle includes an ejection chamber to hold an amount of fluid; an opening to dispense the amount of fluid; and a fluid actuator, disposed within the ejection chamber, to eject the amount of fluid through the opening. Each nozzle also includes an inlet passage, formed in a substrate, to deliver fluid into the ejection chamber and an outlet passage, formed in the substrate, to deliver fluid out of the ejection chamber. The fluidic ejection die also includes an array of channels, formed on a back surface of the substrate and divided into inlet channels and outlet channels, Each inlet channel is fluidly connected to a respective plurality of inlet passages and each outlet channel is fluidly connected to a respective plurality of outlet passages.

The present specification also describes a printing fluid cartridge. The printing fluid cartridge includes a housing and a reservoir disposed within the housing to contain fluid to be deposited on a substrate. The cartridge also includes an array of fluidic ejection dies disposed on the housing. Each fluidic ejection die includes an array of nozzles to eject an amount of fluid. Each nozzle includes an ejection chamber to hold the amount of fluid, an opening to dispense the amount of fluid, and a fluid actuator, disposed within the ejection chamber, to eject the amount of fluid through the opening. Each nozzle also includes an inlet passage, formed in a substrate, to deliver fluid into the ejection chamber and an outlet passage, formed in the substrate, to deliver fluid out of the ejection chamber. The fluidic ejection die also includes an array of channels, formed on a back surface of the substrate and divided into inlet channels and outlet channels, Each inlet channel is fluidly connected to a respective plurality of inlet passages and each outlet channel is fluidly connected to a respective plurality of outlet passages.

The present specification also describes a method for making a fluidic ejection die. According to the method, an array of nozzles and corresponding passages through which fluid is ejected are formed. An array of channels are formed on a substrate, the array of channels including inlet channels and outlet channels. The array of nozzles and passages are then joined to the array of channels such that each inlet channel is fluidly connected to a respective plurality of inlet passages and each outlet channel is fluidly connected to a respective plurality of outlet passages.

In summary, using such a fluidic ejection die 1) reduces the effects of fluid viscosity by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, 7) allows for re-priming of the nozzle, and 8) improves print quality by separating waste ink from fresh ink. However, it is contemplated that the devices disclosed herein may address other matters and deficiencies in a number of technical areas.

As used in the present specification and in the appended claims, the term "actuator" refers a nozzle or another non-ejecting actuator. For example, a nozzle, which is an actuator, operates to eject fluid from the fluidic ejection die. A recirculation pump, which is an example of a non-ejecting actuator, moves fluid through the passages, channels, and pathways within the fluidic ejection die.

Accordingly, as used in the present specification and in the appended claims, the term "nozzle" refers to an individual component of a fluidic ejection die that dispenses fluid onto a surface. The nozzle includes at least an ejection chamber, an ejector fluid actuator, and a nozzle opening.

Further, as used in the present specification and in the appended claims, the term "printing fluid cartridge" may refer to a device used in the ejection of ink, or other fluid, onto a print medium. In general, a printing fluid cartridge may be a fluidic ejection device that dispenses fluid such as ink, wax, polymers or other fluids. A printer cartridge may include fluidic ejection dies. In some examples, a printer cartridge may be used in printers, graphic plotters, copiers and facsimile machines. In these examples, a fluidic ejection die may eject ink, or another fluid, onto a medium such as paper to form a desired image.

Even further, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1A is a view of a fluidic ejection die (100) with inlet and outlet channels, according to an example of the principles described herein. As described above, the fluidic ejection die (100) refers to a component of a printing system used in depositing printing fluids onto a substrate. The fluidic ejection die (100) is an example of a fluidic die that includes nozzle openings, ejection chambers, and actuating ejectors. By comparison a non-ejecting fluidic die may not include actuating ejectors and nozzle openings, but rather includes a fluidic chamber that receives fluid and a sensor disposed within. A non-ejecting fluidic die and a fluidic ejection die, may have other components that are similar, such as the inlet and outlet passages, inlet and outlet channels, and fluid supply slots as described herein. To eject the printing fluid onto the substrate, the fluidic ejection die (100) includes an array of nozzles. Fluid is expelled by the fluidic ejection die through an opening (102) of the nozzle. For simplicity in FIG. 1A, one nozzle opening (102) has been indicated with a reference number. Moreover, it should be noted that the relative size of the nozzle openings (102) and the fluidic ejection die (100) are not to scale, with the nozzles being enlarged for purposes of illustration.

The nozzle openings (102) of the fluidic ejection die (100) may be arranged in columns or arrays such that properly sequenced ejection of fluid from the nozzle openings (102) causes characters, symbols, and/or other graphics or images to be printed on the print medium as the fluidic ejection die (100) and print medium are moved relative to each other.

In one example, the nozzles in the array may be further grouped. For example, a first subset of nozzles of the array may pertain to one color of ink, or one type of fluid with a set of fluidic properties, while a second subset of nozzles of the array may pertain to another color of ink, or fluid with a different set of fluidic properties.

The fluidic ejection die (100) may be coupled to a controller that controls the fluidic ejection die (100) in ejecting fluid from the nozzle openings (102). For example, the controller defines a pattern of ejected fluid drops that form characters, symbols, and/or other graphics or images on the print medium. The pattern of ejected fluid drops is determined by the print job commands and/or command parameters received from a computing device.

The fluidic ejection die (100) may be formed of various layers. For example, a nozzle substrate (104) may define the ejection chambers and openings (102) of a nozzle. The nozzle substrate (104) may be formed of SU-8 or other material. The fluidic ejection die (100) also includes a channel substrate (106) that defines channels and fluid inlets/outlets. The fluid inlet/outlet passages pass fluid to and from the ejection chambers and the fluid channels direct macro-flow from the fluid supply slots to the fluid inlet/outlet passages. The channel substrate (106) may be formed of silicon.

Figure 1B:
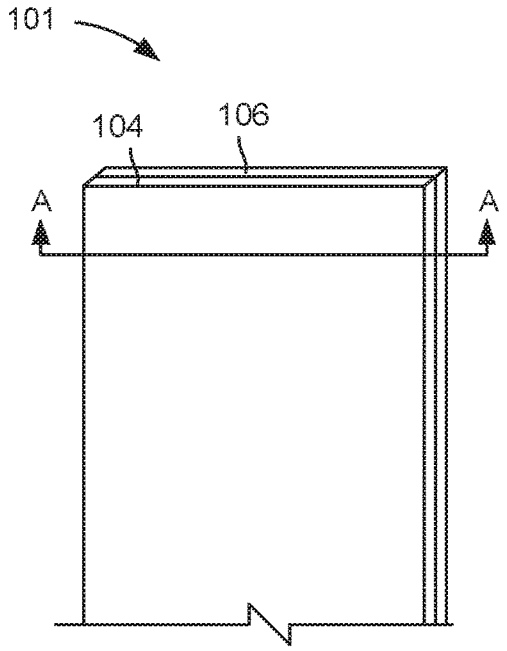
FIGS. 1B and 1C are views of a fluidic die with inlet channels and outlet channels, according to an example of the principles described herein.
Figure 1C:
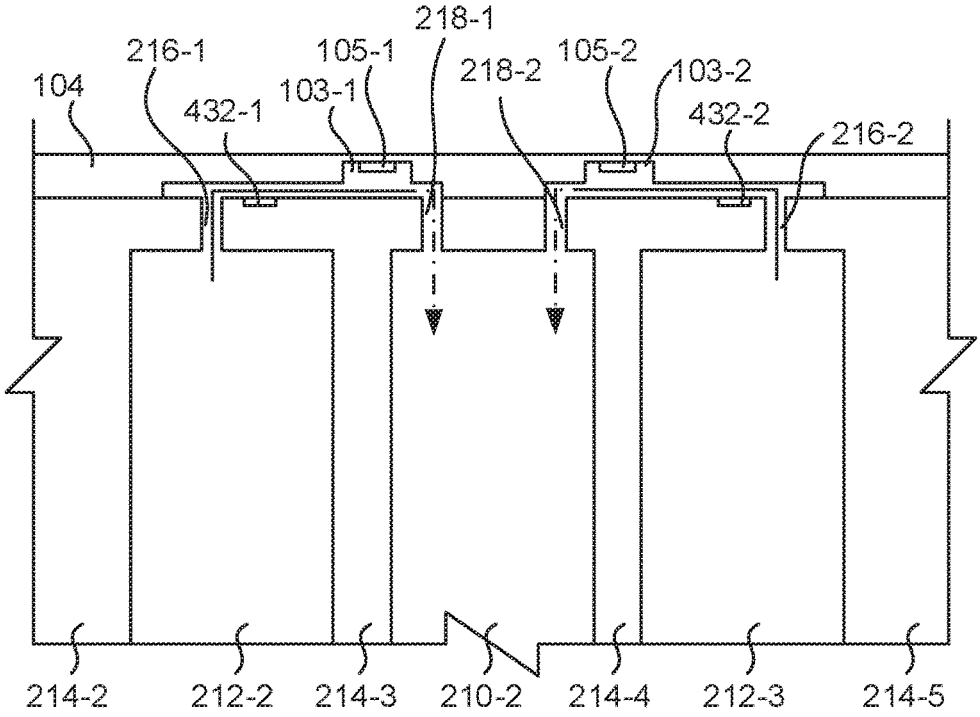

FIGS. 1B and 1C are views of a non-ejecting fluidic die (101) with inlet and outlet channels, according to an example of the principles described herein. Specifically, FIG. 1B is a top view of the fluidic die (101) and FIG. 1C is a cross-sectional view taken along the line "A" In FIG. 1C. As described above, the fluidic die (101) is similar to a fluidic ejection die (FIG. 1A, 100) except that the fluidic die (101) does not eject fluid, and therefore does not include nozzle openings (FIG. 1A, 102).

The non-ejecting fluidic die (101), similar to the fluidic ejection die (100) may be formed of various layers. For example, a substrate (104) may define the fluid chambers (103-1, 103-2). The substrate (104) may be formed of SU-8 or other material. The fluidic die (101) also includes a channel substrate (106) that defines channels and fluid inlets/outlets. The fluid inlet/outlet passages pass fluid to and from the fluid chambers (103) and the fluid channels direct macro-flow from the fluid supply slots to the fluid inlet/outlet passages. The channel substrate (106) may be formed of silicon.

FIG. 1C clearly depicts the fluid flow through the channels (212, 210) and the passages (216, 218). As depicted, the flow through the passages (216, 218) is perpendicular to the flow through the channels (210, 210). That is, as the fluid flows through the inlet channels (212), it changes direction perpendicularly as it passes through the inlet passage (216) to be directed to the fluid chambers (103). The flow through the channels (210, 212) and passages (216, 218) is indicated by arrows in FIG. 1C. In some examples, the fluid chambers (103) include sensors (105-1, 105-2). The sensors (105-1, 105-2) or other components may analyze or otherwise process the fluid passing therethrough.

In some examples, the fluidic die (101) may include a micro-channel to direct fluid to and from the corresponding fluid chambers (103). Such micro-channels may be of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). In this example, the micro-channels and the passages (216, 218) form a micro-recirculation loop. In some examples, a pump fluid actuator (432-1, 432-2) is disposed within a channel to move the fluid to and from the fluid chamber (103). Such micro-channels prevent sedimentation of the fluid passing there through and ensures that fresh fluid is available within the fluid chamber (103). The fluid actuators may be electrostatic membrane actuators, mechanical/impact driven membrane actuators, magneto-strictive drive actuators, or other such elements that may cause displacement of fluid responsive to electrical actuation.

Moreover, inlet passages (216) which deliver fluid to the fluid chamber (103) receive fluid from an inlet channel (212) which inlet channel (212) is separate from an outlet channel (210) which receives fluid that has already passed by the fluid chamber (103) and actuation pump (432). As indicated in FIG. 1C, in some examples, fluid chambers (103) that receive fluid from different inlet channels (212-2, 212-3) may pass waste fluid to a shared outlet channel (210-2) albeit by different outlet passages (218-1, 218-2).

Figure 2A:
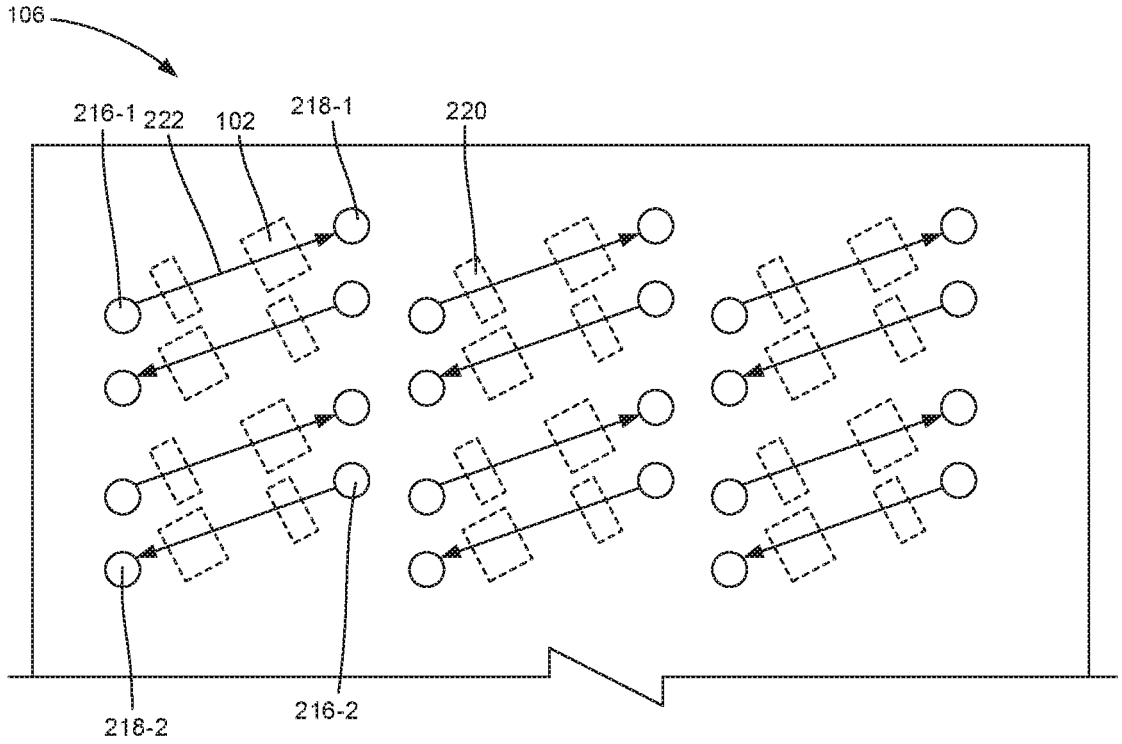
FIGS. 2A and 2B are views of a channel substrate of a fluidic ejection die with inlet and outlet channels, according to an example of the principles described herein.
Figure 2B:
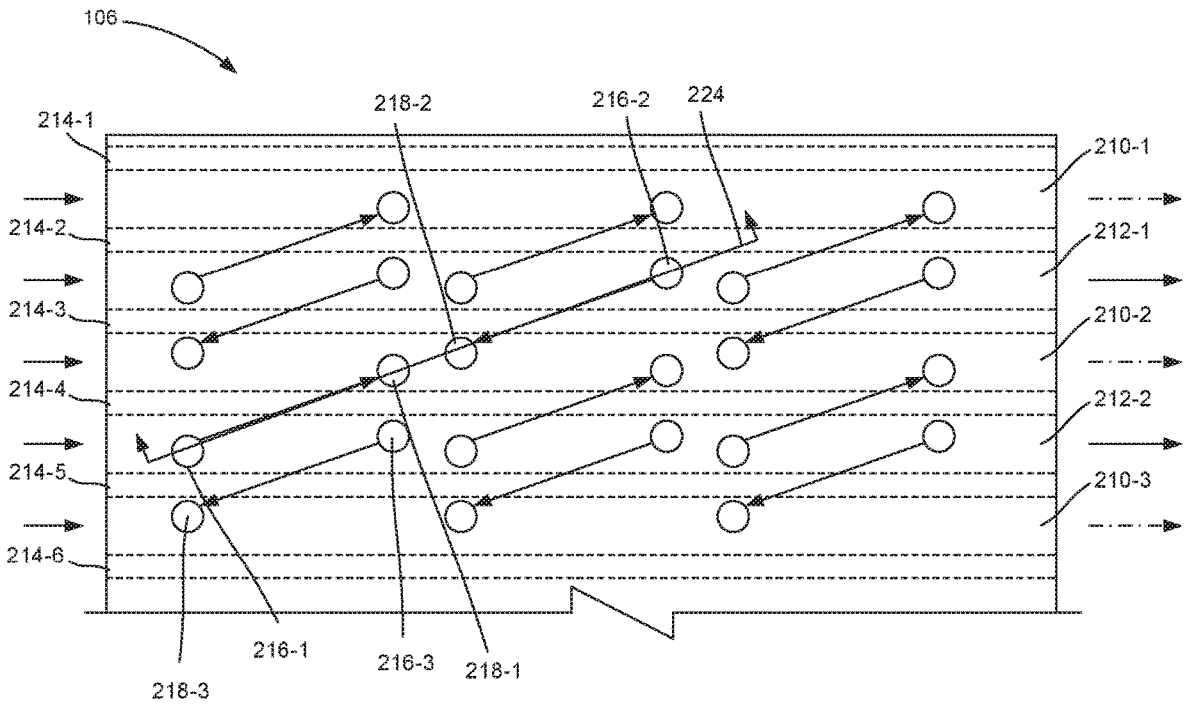

FIGS. 2A and 2B are views of a channel substrate (106) of a fluidic ejection die (FIG. 1A, 100) with inlet and outlet channels, according to an example of the principles described herein. Specifically, FIG. 2A is a view of the channel substrate (106) with components above the top surface of the channel substrate (106) shown in dashed lines and FIG. 2B is a view of the channel substrate (106) with components on a bottom surface of the channel substrate (106) shown in dashed lines. In FIG. 2A these dashed components include the nozzle openings (102) and micro-recirculation pumps (220) which micro-recirculation pumps (220) are used to move fluid through a micro-recirculation loop. The micro-recirculation pumps (220) may be disposed between the nozzle substrate (FIG. 1A, 104) and the channel substrate (106). For simplicity, one instance of each of the nozzle opening (102) and micro-recirculation pump (220) is indicated with a reference number.

Note that in FIGS. 2A and 2B, the nozzle substrate (FIG. 1A, 104) has been removed to illustrate components of the nozzle including channels (210, 212), ribs (214), and passages (216, 218). For simplicity, a one, or a few, instances of each component in FIGS. 2A and 2B are indicated with reference numbers.

The fluidic ejection die (FIG. 1A, 100) also includes an array of passages (216, 218) that are formed in a channel substrate (106). As noted above, just a few instances of the passages (216, 218) are indicated with reference numbers. The passages (216, 218) deliver fluid to and from the corresponding ejection chambers. Specifically, inlet passages (216) deliver fluid from an inlet channel (212) to an ejection chamber of a nozzle and an outlet passage (218) delivers fluid out of the ejection chamber to an outlet channel (210). In use, fluid passes through an inlet passage (216) to a micro-recirculation loop where it is used by a nozzle, and then exits an outlet passage (218). The flow of fluid through the inlet passages is indicated by an arrow (222) in FIGS. 2A and 2B.

In some examples, the passages (216, 218) are formed in a perforated membrane of the channel substrate (106). For example, the channel substrate (106) may be formed of silicon, and the passages (216, 218) may be formed in a perforated silicon membrane that forms part of the channel substrate (106). That is, the membrane may be perforated with holes which, when joined with the nozzle substrate (FIG. 1A, 104), align with the ejection chamber to form paths of ingress and egress of fluid during the ejection process. As depicted in FIG. 2A, two passages, that is an inlet passage (216) and an outlet passage (218) may correspond to each ejection chamber. In some examples, the passages may be round holes, square holes with rounded corners, or other type of passage.

Turning now to FIG. 2B, the fluidic ejection die (FIG. 1A, 100) also includes an array of channels (210, 212). The channels (210, 212) are formed on a backside of the channel substrate (106) as indicated as dashed lines. In other words, as clearly depicted in FIG. 4, the passages (216, 218) are formed on a top surface of the channel substrate (106) and are fluidly connected with channels (212, 210) formed on a back surface of the channel substrate (106).

The channels (210, 212) deliver fluid to and from the passages (216, 218). The channels (210, 212) are divided into inlet channels (212) which are fluidly connected to a plurality of inlet passages (216) and outlet channels (210) which are fluidly connected to a plurality of outlet passages (218). That is, fluid enters a nozzle via an inlet channel (212) and inlet passage (216) and exits via an outlet passage (218) and outlet channel (210). Doing so separates the waste fluid exiting an outlet passage (218) from entering the nozzle via the inlet passage (216).

In some examples, fresh fluid passes into both inlet channels (212) and outlet channels (210). In the case of the inlet channels (212), some of this fluid is passed to inlet passages (216) and some excess fresh fluid exits the inlet channels (212) for example through a shared outlet fluid supply slot. In the case of outlet channels (212), fresh fluid is passed to an outlet channel (210), but does not pass into any inlet passage (216) as the inlet passages (216) are not coupled to outlet channels (210). This fresh fluid also exits the outlet channels (210) through the shared outlet fluid supply slot. That is, the inlet channels (212) and outlet channels (210) are manifolded to a shared inlet fluid supply slot and a shared outlet fluid supply slot, respectively. However, the outlet channels (210) being coupled to outlet passages, also expel waste fluid, in addition to excess fresh fluid, to the shared outlet supply slot.

Returning to the channels (210, 212), the channels (210, 212) are defined by any number of surfaces. For example, one surface of a channel (210, 212) is defined by the membrane portion of the channel substrate (106) in which the passages (216, 218) are formed. Another surface may be defined by a slotted cap substrate and the other surfaces are defined by ribs (214).

These channels (210, 212) promote increased fluid flow through the fluidic ejection die (FIG. 1A, 100). For example, without the channels (210, 212), fluid passing on a backside of the fluidic ejection die (FIG. 1A, 100) may not pass close enough to the passages (216, 218) to sufficiently mix with fluid passing through the nozzles. However, the channels (210, 212) draw fluid closer to the nozzles thus facilitating greater fluid mixing. The increased fluid flow also improves nozzle health as used fluid is removed from the nozzles, which used fluid, if recycled throughout the nozzle, can lead to poor ejection performance or drop quality, and in some cases failure to eject.

In some examples, each inlet channel (212) is disposed between a pair of outlet channels (210). For example, a first inlet channel (212-1) is disposed between a first outlet channel (210-1) and a second outlet channel (210-2), In one specific example, adjacent inlet passages (216) that are coupled to a particular inlet channel (212) are fluidly connected to outlet channels (210) on either side of the particular inlet channel (212). For example, one inlet passage (216-1) fluidly connected to a second inlet channel (212-2) may correspond to an outlet passage (218-1) fluidly connected to the second outlet channel (210-2) and another inlet passage (216-3) fluidly connected to the second inlet channel (212-2) may correspond to an outlet passage (218-3) fluidly connected to the third outlet channel (210-3).

Separating waste fluid from fresh fluid, for example via the inlet channels (212) and outlet channels (210) increases the performance of an associated printing device. For example, by ensuring that waste fluid does not pass to an inlet passage (216), the deleterious characteristics of waste fluid, i.e., increased heat, increased viscosity, have no impact on the fluid entering the inlet passage (216). In the example depicted in FIG. 2B, each channel, both inlet channels (212) and outlet channels (210) receive fluid from the fluid supply slot. Fluid then exits each inlet channel (212) and outlet channel (210) with the difference being that fluid exiting an outlet channel (212) includes, in addition to the fresh fluid supplied therein, waste fluid expelled from the nozzle. Mixed fluid is indicated in FIG. 2B by a dashed dot-line.

Figure 3:
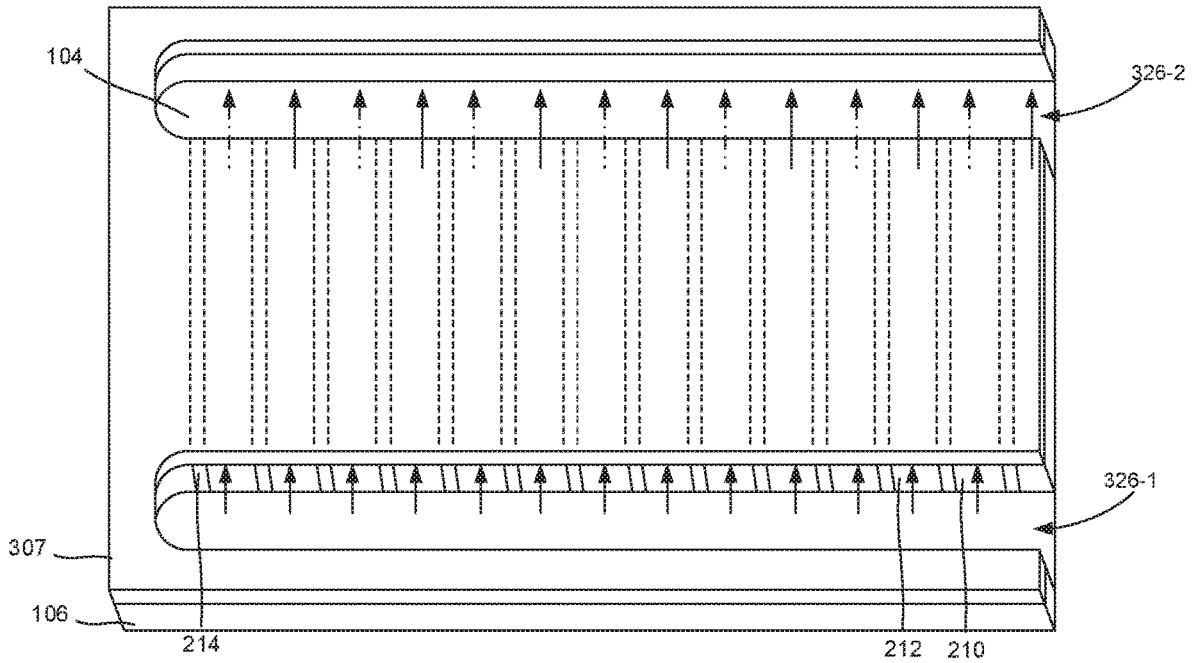
FIG. 3 is a bottom view of a fluidic ejection die with inlet and outlet channels, according to an example of the principles described herein.

FIG. 3 is a bottom view of a fluidic ejection die (FIG. 1A, 100) with inlet and outlet channels (210, 212), according to an example of the principles described herein. Specifically, FIG. 3 depicts a slotted cap substrate (307) and the backside of the channel substrate (106) which defines the channels (212, 210) through which fluid flows. FIG. 3 also depicts the underside of the nozzle substrate (104) on which the nozzle openings (FIG. 1A, 102) are formed. FIG. 3 also depicts the ribs (214) that define the channels (212, 210). For simplicity, in FIG. 3 a single instance of many of the components are indicated with a reference number.

FIG. 3 also depicts the fluid supply slots (326-1, 326-2) that supply fluid to and from the various channels (210, 212). The fluid supply slots (326) are formed in the slotted cab substrate (307) and supply fluid to the channels (212, 210).

As noted above, fluid going into each of the channels (212, 210) may be the same, i.e., fresh fluid. However, the fluid coming out of the outlet channels (210) may be mixed with waste fluid following activation by the actuation pumps and ejectors. The fresh/waste mixed fluid is indicated with a dashed-dot line in FIG. 3.

Figure 4:
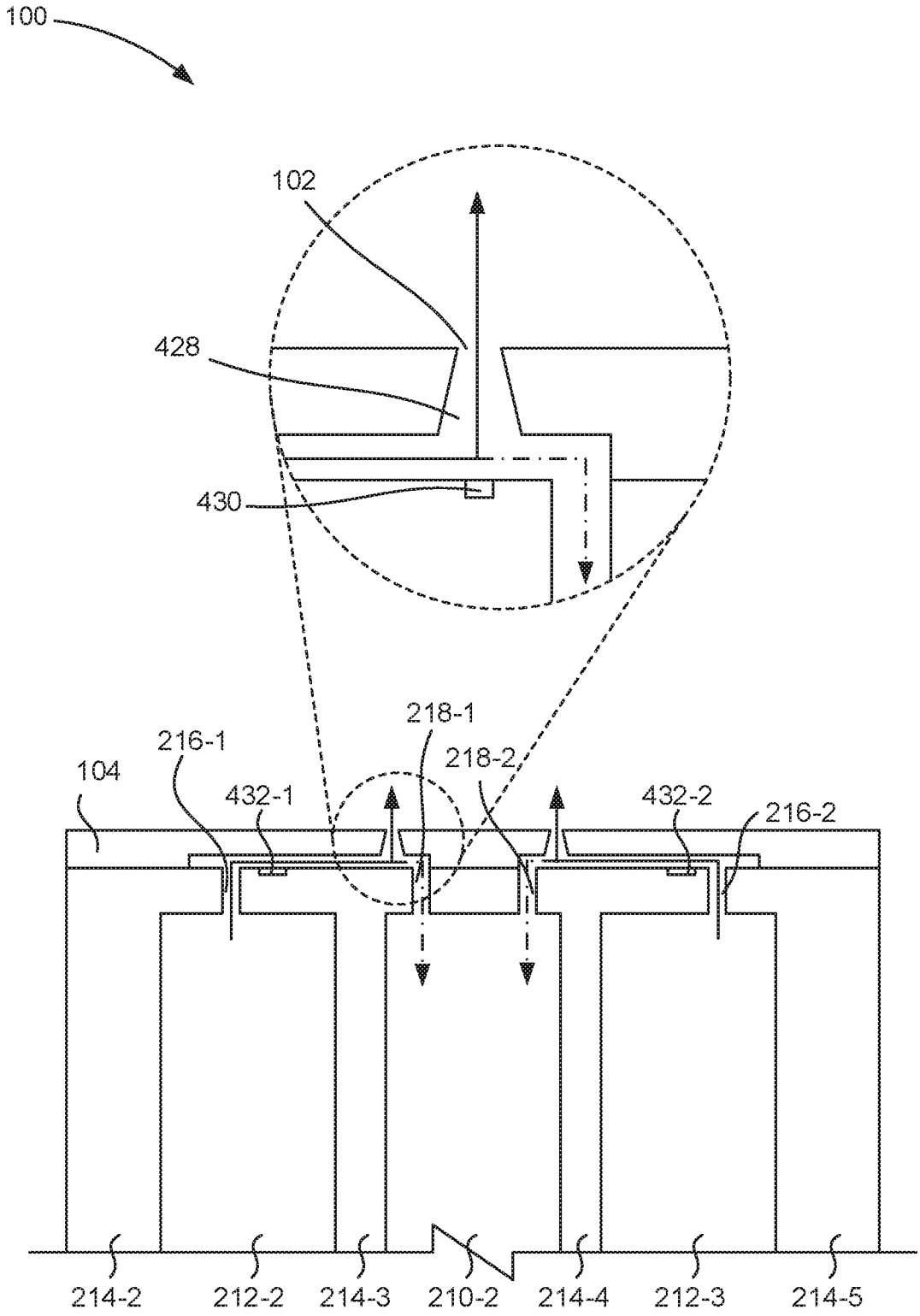
FIG. 4 is a cross-sectional view of a fluidic ejection die with inlet and outlet channels, according to an example of the principles described herein.

FIG. 4 is a cross-sectional view of a fluidic ejection die (100) with inlet and outlet channels (210, 212), according to an example of the principles described herein. FIG. 4 clearly depicts the fluid flow through the channels (212, 210) and the passages (216, 218). As depicted, the flow through the passages (216, 218) is perpendicular to the flow through the channels (210, 210). That is, as the fluid flows through the inlet channels (212), it changes direction perpendicularly as it passes through the inlet passage (216) to be directed to the nozzles. The flow through the channels (210, 212) and passages (216, 218) is indicated by arrows in FIG. 4.

Among other things, FIG. 4 depicts nozzles of the array. For simplicity, the components of one nozzle in FIG. 4 are depicted with reference numbers. To eject fluid, the nozzle includes a number of components. For example, a nozzle includes an ejection chamber (428) to hold an amount of fluid to be ejected, an opening (102) through which the amount of fluid is ejected, and an ejecting fluid actuator (430), disposed within the ejection chamber (428), to eject the amount of fluid through the opening (102). The ejection chamber (428) and nozzle opening (102) may be defined in a nozzle substrate (104) that is deposited on top of a channel substrate (FIG. 1A, 106).

Turning to the ejecting actuators (430), the ejecting fluid actuator (430) may include a firing resistor or other thermal device, a piezoelectric element, or other mechanism for ejecting fluid from the ejection chamber (428), For example, the ejector (430) may be a firing resistor. The firing resistor heats up in response to an applied voltage. As the firing resistor heats up, a portion of the fluid in the ejection chamber (428) vaporizes to form a bubble. This bubble pushes fluid out the opening (102) and onto the print medium. As the vaporized fluid bubble pops, fluid is drawn into the ejection chamber (428) from a passage (216), and the process repeats. In this example, the fluidic ejection die (100) may be a thermal inkjet (TIJ) fluidic ejection die (100).

In another example, the ejecting fluid actuator (430) may be a piezoelectric device. As a voltage is applied, the piezoelectric device changes shape which generates a pressure pulse in the ejection chamber (428) that pushes the fluid out the opening (102) and onto the print medium. In this example, the fluidic ejection die (100) may be a piezoelectric inkjet (PIJ) fluidic ejection die (100).

In some examples, in addition to the ejecting fluid actuators (430), ejection chambers (428), and openings (102), each nozzle may include a micro-channel to direct fluid to and from the corresponding ejection chambers (428). Such micro-channels may be of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). In this example, the micro-channels and the passages (216, 218) that correspond to the nozzle form a micro-recirculation loop. In some examples, a pump fluid actuator (432-1, 432-2) is disposed within a channel to move the fluid to and from the ejection chamber (428). Such micro-channels prevent sedimentation of the fluid passing there through and ensures that fresh fluid is available for ejection through the opening (102). The fluid actuators, both the ejectors (430) and the pump actuators (432) may be electrostatic membrane actuators, mechanical/impact driven membrane actuators, magneto-strictive drive actuators, or other such elements that may cause displacement of fluid responsive to electrical actuation.

As described above, such micro-recirculation loops provide fresh fluid to the ejection chamber (428), thus increasing the effective life of a nozzle. This is because the nozzles operate best when provided with fresh fluid.

Moreover, as described above, inlet passages (216) which deliver fluid to the ejection chamber (428) receive fluid from an inlet channel (212) which inlet channel (212) is separate from an outlet channel (210) which receives fluid that has already passed by the nozzle and actuation pump (432). As indicated in FIG. 4, in some examples, nozzles that receive fluid from different inlet channels (212-2, 212-3) may pass waste fluid to a shared outlet channel (210-2) albeit by different outlet passages (218-1, 218-2).

Figure 5:
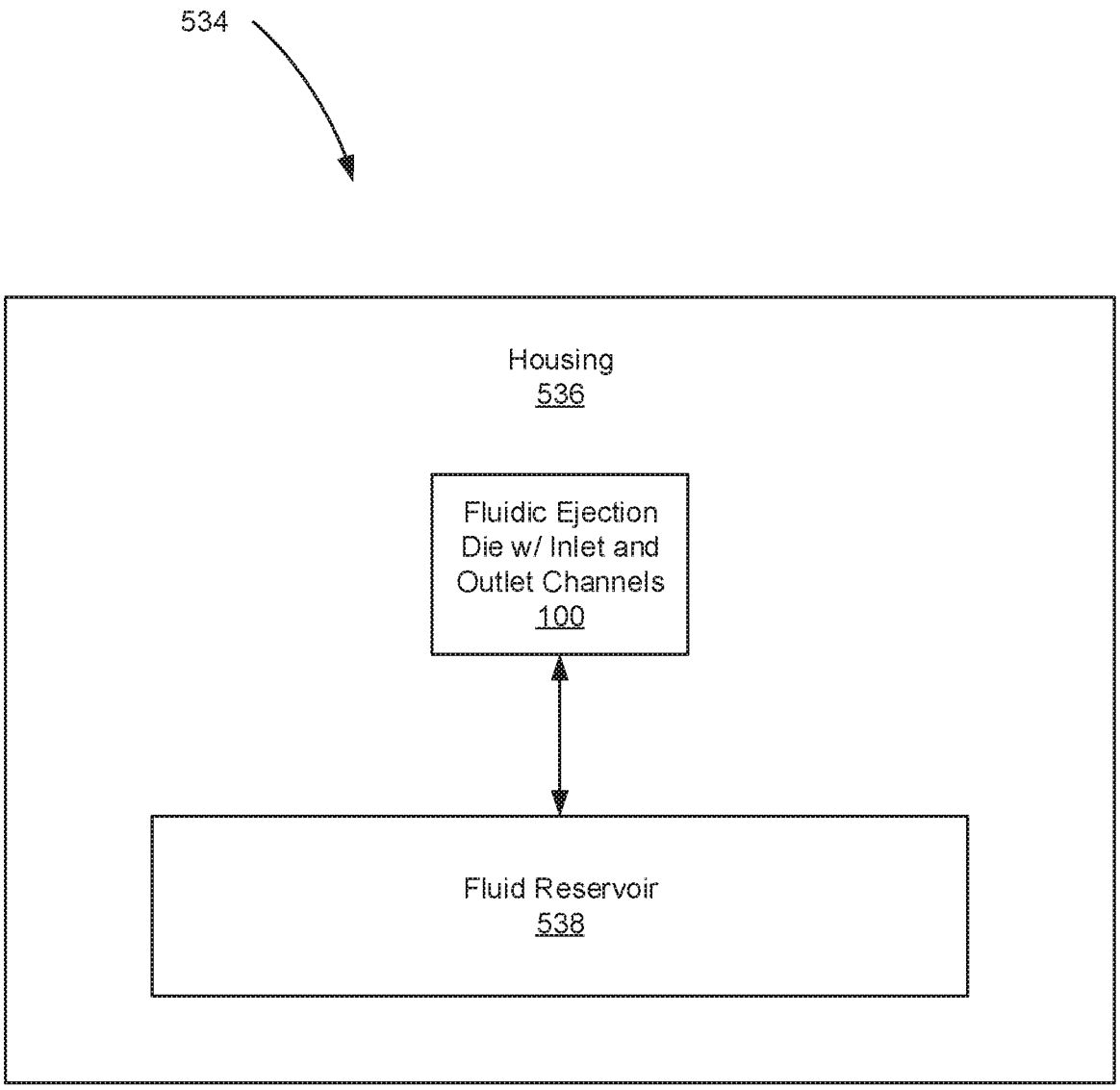
FIG. 5 is a block diagram of a printing fluid cartridge including a fluidic ejection die with inlet and outlet channels, according to an example of the principles described herein.

FIG. 5 is a block diagram of a printing fluid cartridge (534) including a fluidic ejection die (100) with inlet and outlet channels (FIG. 2B, 210, 212), according to an example of the principles described herein. The printing fluid cartridge (534) is used within a printing system to eject a fluid. In some examples, the printing fluid cartridge (534) may be removable from the system for example, as a replaceable cartridge (534). In some examples, the printing fluid cartridge (534) is a substrate-wide printbar and the array of fluidic ejection dies (100) are grouped into fluid ejection devices that are staggered across a width of a substrate on which the fluid is to be deposited.

The printing fluid cartridge (534) includes a housing (536) to house components of the printing fluid cartridge (534). The housing (536) houses a fluid reservoir (538) to supply an amount of fluid to the fluidic ejection die (100). In general, fluid flows between the reservoir (538) and the fluidic ejection die (100). In some examples, a portion of the fluid supplied to fluidic ejection die (100) is consumed during operation and fluid not consumed during printing is returned to the fluid reservoir (538). In some examples, the fluid may be ink. In one specific example, the ink may be a water-based ultraviolet (UV) ink, pharmaceutical fluid, or 3D printing material, among other fluids.

Figure 6:
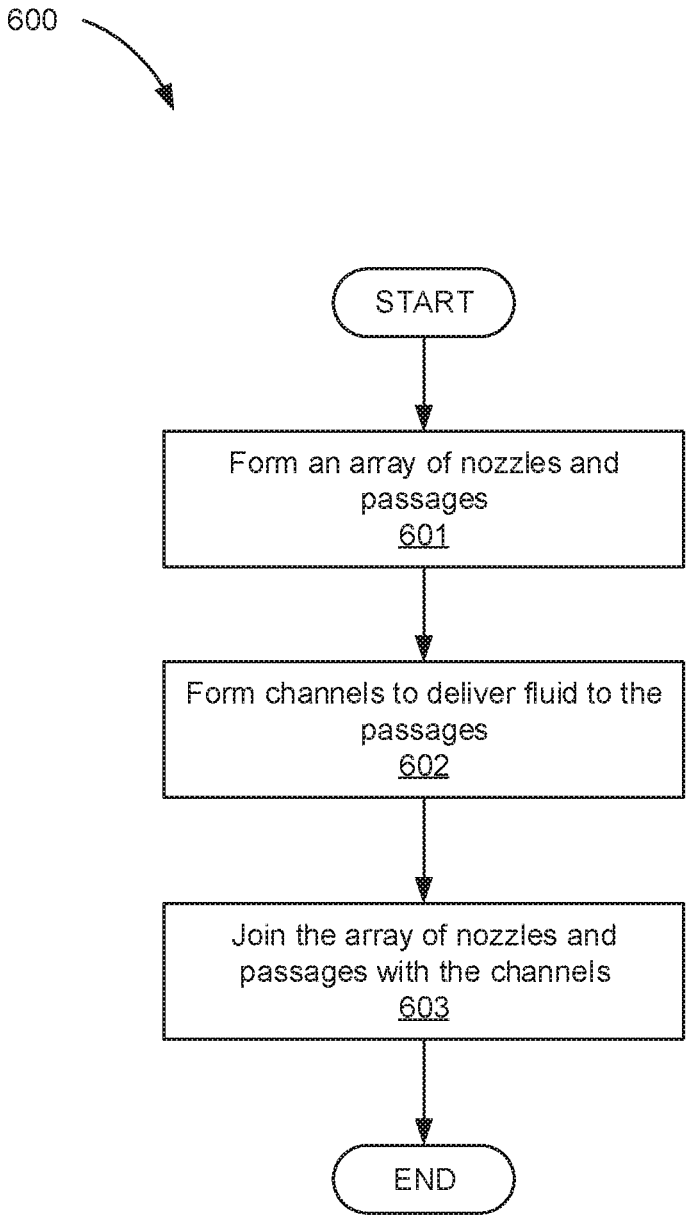
FIG. 6 is a flowchart of a method for forming a fluidic ejection die with inlet and outlet channels, according to an example of the principles described herein.

FIG. 6 is a flowchart of a method (600) for forming a fluidic ejection die (FIG. 1A, 100) with inlet and outlet channels (FIG. 2B, 210, 212), according to an example of the principles described herein. According to the method (600), an array of nozzles and passages (FIG. 2A, 216, 218) are formed (block 601). In some examples, the passages (FIG. 2A, 216, 218) may be part of a perforated silicon membrane. The nozzles, or rather the openings (FIG. 1A, 102) and the ejection chambers (FIG. 4, 428) of the nozzles, may be formed of a nozzle substrate (FIG. 1A, 104) such as SU-8. Accordingly, forming (block 601) the array of nozzles and passages (FIG. 2A, 216, 218) may include joining the perforated silicon membrane with the SU-8 nozzle substrate (FIG. 1A, 104).

Inlet and outlet channels (FIG. 2B, 210, 212) are then formed (block 602). Forming (block 602) the Inlet and outlet channels (FIG. 2B, 210, 212) may include adhering ribs (FIG. 2B, 214) to the backside of the membrane in which the passages (FIG. 2A, 216, 218) are formed. In another example the formation (block 602) may include etching away the channel substrate (FIG. 1A, 106) to form the ribs (FIG. 2B, 214) which define in part the inlet and outlet channels (FIG. 2A, 210, 212).

With the inlet and outlet channels (FIG. 2B, 210, 212) formed and the nozzles and passages (FIG. 2B, 210, 212) formed, the two are joined (block 603) to form the fluidic ejection die (FIG. 1A, 100) with inlet and outlet channels (FIG. 2B, 210, 212). Specifically, the two are joined such that each inlet channel (FIG. 2B, 212) is fluidly connected to a respective plurality of inlet passages (FIG. 2A, 216) and such that each outlet channel (FIG. 2B, 210) is fluidly connected to a respective plurality of outlet passages (FIG. 2A, 218).

In summary, using such a fluidic ejection die 1) reduces the effects of fluid viscosity by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, 7) allows for re-priming of the nozzle, and 8) improves print quality by separating waste ink from fresh ink. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic ejection die, comprising:
an array of nozzles, each nozzle comprising:
an ejection chamber;
an opening; and
a fluid actuator disposed within the ejection chamber;
an inlet passage, formed in a substrate, to deliver fluid into the ejection chamber; and
an outlet passage, formed in the substrate, to deliver fluid out of the ejection chamber;
an array of channels, formed on a back surface of the substrate, the array of channels divided into inlet channels and outlet channels, wherein:
each inlet channel is fluidly connected to a respective plurality of inlet passages; and
each outlet channel is fluidly connected to a respective plurality of outlet passages; and
a micro-recirculation pump disposed between each inlet passage and outlet passage to circulate the fluid into that inlet passage and out of that outlet passage in a pulsating manner to cause vortices in the fluid in a corresponding outlet channel.

2. The fluidic ejection die of claim 1, wherein each inlet channel is disposed between a pair of outlet channels.

3. The fluidic ejection die of claim 1, wherein adjacent inlet passages coupled to a particular inlet channel are fluidly connected to outlet channels on either side of the particular inlet channel.

4. The fluidic ejection die of claim 1, wherein the inlet channels and outlet channels are fluidly coupled to a shared outlet fluid supply slot.

5. The fluidic ejection die of claim 4, wherein:
excess fresh fluid passes from the inlet channels to the shared outlet fluid supply slot; and
excess fresh fluid and waste fluid pass from the outlet channels to the shared outlet fluid supply slot.

6. The fluidic ejection die of claim 1, wherein the passages are formed in a perforated layer of the substrate.

7. The fluidic ejection die of claim 1, wherein each nozzle further comprises a micro-recirculation channel to direct fluid to and from the corresponding ejection chamber.

8. The fluidic ejection die of claim 1, wherein the inlet channels and the outlet channels are both fluidly coupled to, and receive fresh fluid from, a shared inlet fluid supply slot.

9. A fluidic ejection die, comprising:
an array of nozzles, each nozzle comprising:
an ejection chamber;
an opening; and
a fluid actuator disposed within the ejection chamber;
an inlet passage, formed in a substrate, to deliver fluid into the ejection chamber; and
an outlet passage, formed in the substrate, to deliver fluid out of the ejection chamber;
an array of channels, formed on a back surface of the substrate, the array of channels divided into inlet channels and outlet channels, wherein:
each inlet channel is fluidly connected to a respective plurality of inlet passages; and
each outlet channel is fluidly connected to a respective plurality of outlet passages; wherein the inlet channels and outlet channels are fluidly coupled to a shared inlet fluid supply slot.

10. The fluidic ejection die of claim 9, wherein the inlet channels and the outlet channels receive fresh fluid from the shared inlet fluid supply slot.

11. The fluidic ejection die of claim 9, wherein each inlet channel is disposed between a pair of outlet channels.

12. The fluidic ejection die of claim 9, wherein adjacent inlet passages coupled to a particular inlet channel are fluidly connected to outlet channels on either side of the particular inlet channel.

13. The fluidic ejection die of claim 9, wherein the inlet channels and outlet channels are fluidly coupled to a shared outlet fluid supply slot.

14. The fluidic ejection die of claim 13, wherein:
excess fresh fluid passes from the inlet channels to the shared outlet fluid supply slot; and
excess fresh fluid and waste fluid pass from the outlet channels to the shared outlet fluid supply slot.

15. A printing fluid cartridge, comprising:
a housing;
a reservoir disposed within the housing to contain fluid to be deposited on a substrate;
and an array of fluidic ejection dies disposed on the housing, each fluidic ejection die comprising:
an array of nozzles, each nozzle comprising:
an ejection chamber;
an opening; and
a fluid actuator disposed within the ejection chamber;
an inlet passage, formed in a substrate, to deliver fluid into the ejection chamber; and
an outlet passage, formed in the substrate, to deliver fluid out of the ejection chamber; and
an array of channels, formed on a back surface of the substrate, the array of channels divided into inlet channels and outlet channels, wherein:
each inlet channel is fluidly connected to a respective plurality of inlet passages; and
each outlet channel is fluidly connected to a respective plurality of outlet passages.

16. The printing fluid cartridge of claim 15, wherein the array of channels alternate between inlet channels and outlet channels.

17. The printing fluid cartridge of claim 15, wherein:
the printing fluid cartridge is a page-wide printbar; and
the array of fluid ejection dies are grouped into fluid ejection devices, wherein the fluid ejection devices are staggered across a width of a page of media on which the fluid is to be deposited.

18. The printing fluid cartridge of claim 15, wherein fluid flow through the channels is perpendicular to fluid flow in the passages.

19. A method for making a fluidic ejection die comprising:

forming an array of nozzles and corresponding passages through which fluid is ejected;

forming an array of channels on a substrate, wherein the number of channels are divided into inlet channels and outlet channels;

joining the array of nozzles and corresponding passages slots to the number of channels such that:

each inlet channel is fluidly connected to a respective plurality of inlet passages; and each outlet channel is fluidly connected to a respective plurality of outlet passages; and forming a micro-recirculation pump disposed between each inlet passage and outlet passage to circulate fluid into a corresponding inlet passage and out a corresponding outlet passage in a pulsating manner to cause vortices in the fluid in the outlet channel connected to the corresponding outlet passage.

20. The method of claim 19, wherein forming the number of channels on the substrate comprises etching the back layer of the substrate.

* * * * *